US008724842B2

(12) United States Patent
Sumitani et al.

(10) Patent No.: US 8,724,842 B2
(45) Date of Patent: May 13, 2014

(54) UNIVERSAL ANGLE LOUDSPEAKER BRACKET

(75) Inventors: Yoichiro Sumitani, Rancho Palos Verdes, CA (US); Chun-Yi Lin, New Taipei (TW); Yu-Ling Cheng, New Taipei (TW); Chih-Huang Hsiao, New Taipei (TW)

(73) Assignee: Sound Sources Technology, Inc., Torrance, CA (US)

( * ) Notice: Subject to any disclaimer, the term of this patent is extended or adjusted under 35 U.S.C. 154(b) by 0 days.

(21) Appl. No.: 13/425,745

(22) Filed: Mar. 21, 2012

(65) Prior Publication Data

US 2013/0251187 A1 Sep. 26, 2013

(51) Int. Cl.
*H04R 1/02* (2006.01)

(52) U.S. Cl.
USPC ..... 381/387; 381/386; 381/395; 248/299.1

(58) Field of Classification Search
USPC ..... 381/386, 387, 389, 395, 390, 355, 356; 248/278.1, 279.1, 286.1, 652, 299.1
See application file for complete search history.

(56) References Cited

U.S. PATENT DOCUMENTS

| | | | | |
|---|---|---|---|---|
| 2,898,068 | A | 8/1959 | Warren | |
| 2,922,609 | A | 1/1960 | Collier | |
| 3,661,376 | A | 5/1972 | Hill et al. | |
| 4,325,529 | A | 4/1982 | Seebinger | |
| D362,253 | S | 9/1995 | Vogels | |
| D395,892 | S | 7/1998 | Solomon | |
| 5,924,665 | A | 7/1999 | Sweere et al. | |
| 6,347,776 | B1 | 2/2002 | Chuang | |
| 7,438,269 | B2 | 10/2008 | Pfister et al. | |
| 7,455,271 | B2 | 11/2008 | Pincek et al. | |
| 7,513,474 | B2 | 4/2009 | Anderson et al. | |
| 7,883,065 | B2 | 2/2011 | Nelson | |
| 8,023,684 | B2 * | 9/2011 | Wathen | 381/387 |
| 2007/0025580 | A1 * | 2/2007 | Reardon et al. | 381/387 |
| 2007/0075202 | A1 | 4/2007 | Gordon | |
| 2011/0228967 | A1 | 9/2011 | Kulchy et al. | |

* cited by examiner

*Primary Examiner* — Curtis Kuntz
*Assistant Examiner* — Joshua A Kaufman
(74) *Attorney, Agent, or Firm* — Stetina Brunda Garred & Brucker

(57) ABSTRACT

An apparatus for mounting a loudspeaker unit to a structure is disclosed. A primary mounting bracket is defined by an arcuate center section and a pair of opposed arms extending therefrom. There is at least one open groove and at least one substantially coextensive track spanning the arcuate center section. Each of the arms include a circular planar bearing structure rotatably engageable to a corresponding one of bracket coupling platforms on an enclosure of the loudspeaker unit. A tab defining at least one mounting hardware hole in axial alignment with open groove substantially throughout its length is in a guided sliding engagement with the track. The enclosure of the loudspeaker unit is rotatable about a first axis extending between the arms of the primary mounting bracket and about a second axis defined by a radial center of an arc corresponding to a travel path of the tab along the track.

23 Claims, 5 Drawing Sheets

UNIVERSAL ANGLE LOUDSPEAKER BRACKET

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention generally relates to mounting devices for attaching loudspeakers to architectural structures. More particularly, the present invention relates to a universal angle speaker bracket.

2. Related Art

Loudspeakers, or acoustic transducers, are utilized in countless applications in which audio such as music, voice, sound effects, or any combination thereof, is reproduced. These applications may be as miniscule as portable music players, mobile telephone devices and desktop, laptop or tablet computer-based entertainment, medium scale such as car audio installations, home theater installations and other architectural installation, or larger scale such as movie theaters, stadiums, concert venues, and the like. Generally, loudspeakers are utilized anywhere audio communications is desired or needed. The suitable type and size of loudspeakers depends upon the particular requirements of its use.

In a typical configuration that may be utilized across most consumer or consumer-oriented commercial applications, loudspeaker units may be comprised of one or more drivers. It is understood that the diaphragm size of a given driver is directly related to its frequency response characteristics, and so a loudspeaker unit may include one driver (i.e., a tweeter) for higher frequency signals and another driver (e.g., a woofer) for lower frequency signals. Medium frequency signals may be output via the aptly named midrange. Connected to the signal source may be a crossover No matter the number of drivers utilized, they are typically mounted to enclosures, or cabinets, to reduce interference of in-phase sound waves on the front or face of the loudspeaker driver, from out-of-phase sound waves from the rear. Conventional loudspeakers are provided as a standalone unit, and are positioned and oriented in a room as desired by the listener. As understood, the term loudspeaker may refer to individual drivers as well as the combination of one enclosure with multiple drivers.

Due to the directivity of loudspeaker drivers, that is, the quality and maximum energy transfer from the loudspeaker driver to the listener's ears being dependent upon an optimal radiating direction, the placement and orientation is important. Difficulties relating to this issue are often encountered with architectural installations in public spaces and buildings that have unique acoustic characteristics. Further, various advanced applications utilize a combination of audio from a several different loudspeakers each oriented to produce various psycho-acoustic effects. Such surround sound techniques are commonly utilized in home and professional theater installations.

In some installations, it may be desirable to mount individual loudspeaker drivers and loudspeaker units to recede into the architectural structure. One of the most common ways of doing so is by placing the loudspeaker into a predrilled hole in the ceiling or the wall, with the loudspeaker being secured thereto with fasteners such as bolts, screws, and nails. With such an installation, however, unless complicated, location-specific adapters are utilized, the radiating direction is limited to vertical (ceilings and floors) or horizontal (walls). It is also unsatisfactory because the heavy weight of the loudspeaker driver is held by a relatively small and weak area of the structure, and the likelihood of detachment therefore increases.

Alternatively, brackets, adapters, and other hardware can be used to statically mount loudspeaker units to architectural surfaces. Although somewhat more intrusive than in-wall or in-ceiling installations, substantial concealment is possible with colors and exterior stylization that match the surrounding décor. The hardware is relatively easy to install, and can be accomplished with simple hand tools. So long as it was fixed to solid structural components such as studs and beams (rather than drywall, for example) the risk of detachment was minimal. However, the range of possible rotation was limited, if there was any at all, and restricted to a first axis. Thus, due to the restricted orientation range, highly directional loudspeaker driver designs could not be utilized.

Therefore, there is a need in the art for an improved loudspeaker bracket mount that can be oriented in various directions. Furthermore, there is a need in the art for a loudspeaker assembly that is simpler and easier to install and manipulate as the need arises, while also retaining its set orientation indefinitely.

BRIEF SUMMARY

In accordance with one embodiment of the present disclosure, there is contemplated an apparatus for mounting a loudspeaker unit to a structure. The apparatus may include a primary mounting bracket defined by an arcuate center section and a pair of opposed arms extending therefrom. The arcuate center section may define at least one open groove and at least one substantially coextensive track spanning the arcuate center section. Each of the arms may include a circular planar bearing structure that is rotatably engageable to a corresponding one of bracket coupling platforms on an enclosure of the loudspeaker unit. There may also be tab that is in a guided sliding engagement with the track defined on the arcuate center section of the primary mounting bracket. The tab may define at least one mounting hardware hole in axial alignment with the at least one open groove substantially throughout its length. The enclosure of the loudspeaker unit may be is rotatable about a first axis extending between the arms of the primary mounting bracket. Additionally, the enclosure of the loudspeaker unit may be rotatable about a second axis defined by a radial center of an arc corresponding to a travel path of the tab along the track. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The present disclosure contemplates bracket devices for mounting loudspeakers to a structure in various orientations. The detailed description set forth below in connection with the appended drawings is intended as a description of the presently preferred embodiment of such devices, and is not intended to represent the only form in which the present invention may be constructed or utilized. The description sets forth the functions of the devices in connection with the illustrated embodiment. It is to be understood, however, that the same or equivalent functions and may be accomplished by different embodiments that are also intended to be encompassed within the scope of the disclosure. It is further understood that the use of relational terms such as first and second, top and bottom, and the like are used solely to distinguish one from another entity without necessarily requiring or implying any actual such relationship or order between such entities.

Figure 1B:
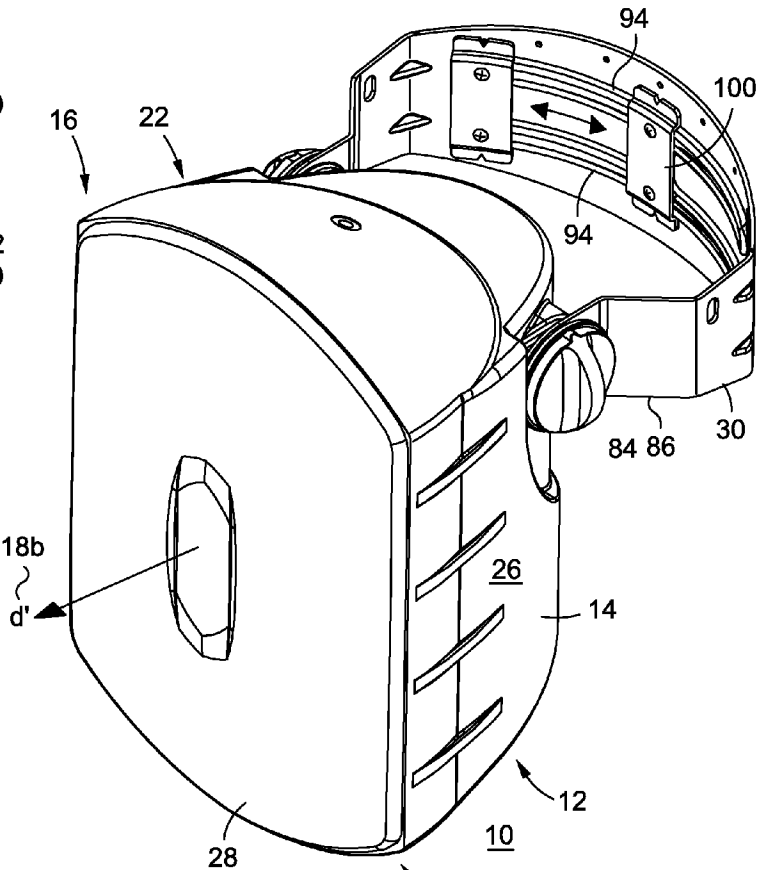
FIG. 1B is a perspective view of the loudspeaker assembly with the primary mounting bracket rotated to a second position.
Figure 1A:
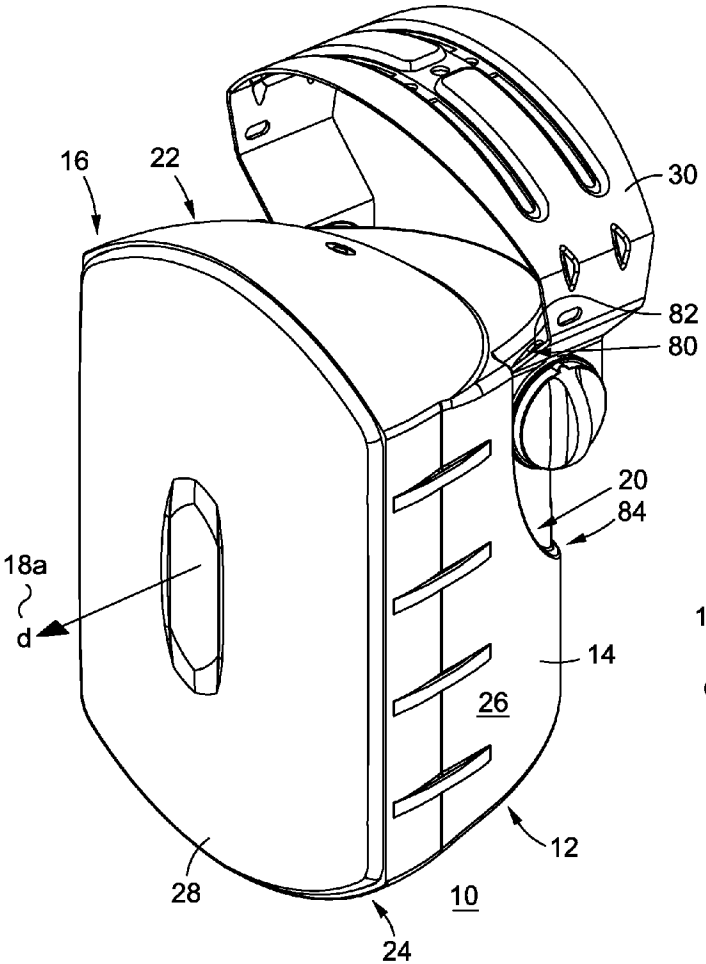
FIG. 1 is a perspective view of a loudspeaker assembly in accordance with one aspect of the present invention with a primary mounting bracket in a first position.

The perspective views of FIGS. 1A and 1B depict one embodiment of a loudspeaker assembly 10 that includes a loudspeaker unit 12. As will be recognized by those having ordinary skill in the art, the loudspeaker unit 12 is generally comprised of an enclosure 14 that houses one or more loudspeaker drivers (not shown), the diaphragms of which face a front section 16 and radiate sound in a direction d 18. In accordance with the embodiments of the present disclosure, it is possible for the loudspeaker unit 12 to be mounted to an architectural structure such that its direction of radiation d 18 is capable of being adjustably oriented utilizing the various features discussed in further detail below. Although the direction of radiation d 18*a* shown in FIG. 1A is depicted as being in the same direction of radiation d' 18*b* of FIG. 1B, it is understood that the mounting orientation is different. In the former, the direction of radiation d 18*a* is substantially parallel to a mounting surface, while in the latter, the direction of radiation d' 18*b* is substantially perpendicular to a mounting surface.

The enclosure 14 may take on a variety of different configurations, but in the illustrated example, it is generally box-shaped. In further detail, the enclosure 14 may be defined by the front section 16 and a back end 20 opposite thereto. There may also be a top 22, a bottom 24, and opposed sides 26. These various sections of the enclosure 14 may be curved and therefore be merged together, with no clear delineation of where one starts and another ends. Furthermore, each of the aforementioned parts of the enclosure 14 may have compound surfaces such as contours. The particular configuration illustrated herein is by way of example only, and any other suitable shape of the enclosure 14 may be substituted depending on the aesthetic needs or desires of a particular application.

The loudspeaker unit 12 includes several components that are common to most other loudspeaker units, the detailed explanation of which will be omitted in favor of a brief general overview. The loudspeaker drivers are covered and concealed by a grill 28 that may be detachably coupled or otherwise positioned on the front section 16 of the enclosure 14. The terminals receptive to the electrical connections from the sound source and any crossover circuitry ting such connections to the individual loudspeaker drivers are also housed within the enclosure 14. In some configurations, an audio amplifier may also be incorporated into the loudspeaker unit 12, in which case such circuitry is likewise housed within the enclosure 14. It will be appreciated that any other suitable loudspeaker unit 12 may be substituted without departing from the scope of the present disclosure.

Figure 2:
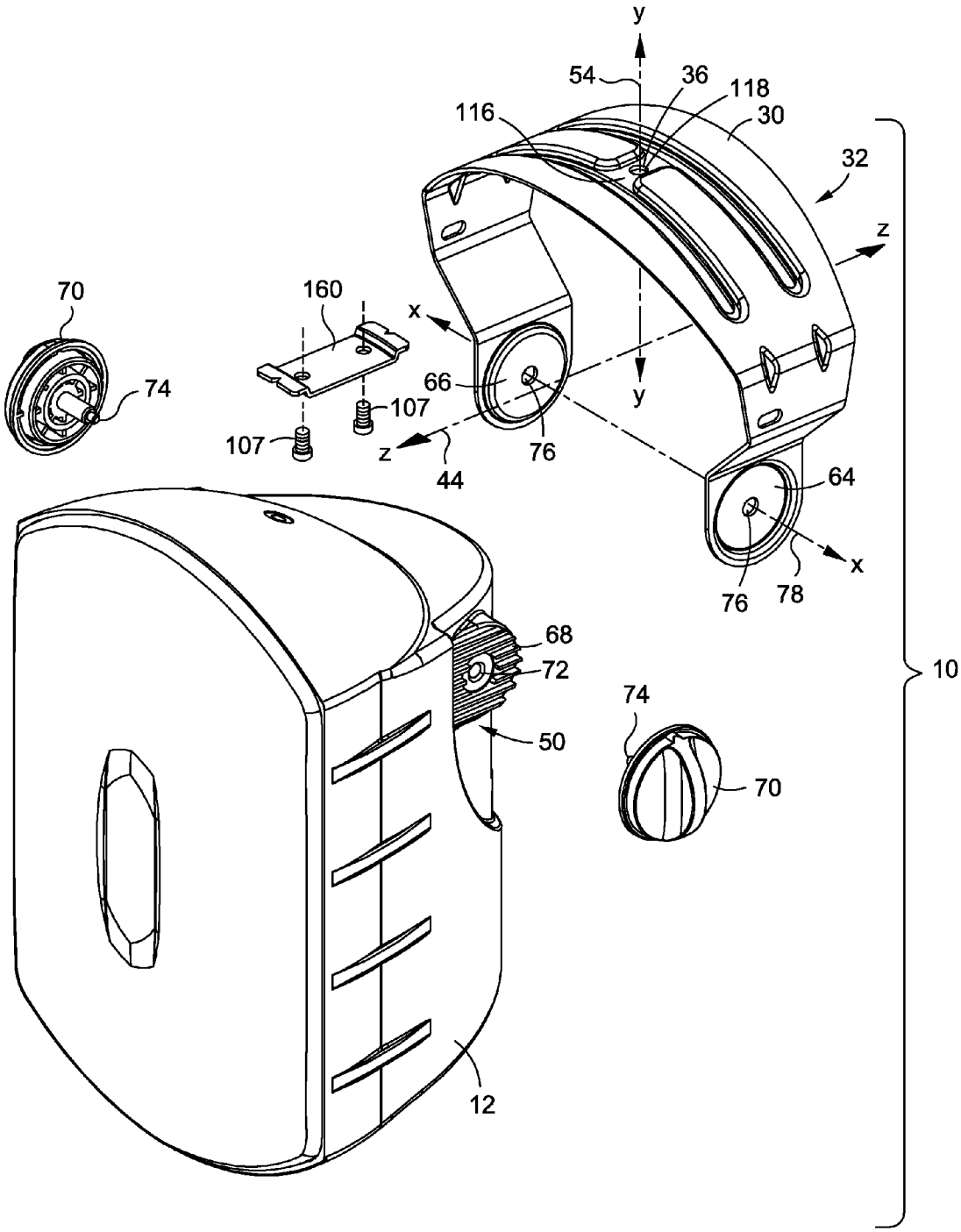
FIG. 2 is an exploded perspective view of the loudspeaker assembly showing the major components of an apparatus for mounting the loudspeaker to a structure in accordance with another aspect of the present invention.

With additional reference to the exploded perspective view of FIG. 2, the loudspeaker assembly 10 includes a primary mounting bracket 30 that is removably coupled to the enclosure 14. The cross-sectional view of FIG. 3A further illustrates the various sections of the primary mounting bracket 30. In one embodiment, the primary mounting bracket 30 is defined by an arcuate center section 32, and a pair of opposed arms 34 extending therefrom. Specifically, the arcuate center section 32 is defined by a center 36 that bisects the arcuate center section 32, a left end 38*a*, and an opposite right end 38*b*. As the name of the feature suggests, the arcuate center section 32 is characterized by an arc C-C 40 extending between the left end 38*a* and the right end 38*b*. The radius $r_{arc}$ 42 is understood to be that of a segment of a geometrically equivalent circle that would correspond to such arc C-C 40. In other words, the arc of the arcuate center section 32 is the traced partial rotation about an axis Z-Z 44 extending from a point spaced apart from arc by the length of radius $r_{arc}$ 42. As will be discussed in further detail below, the axis Z-Z 44 is also one of the contemplated axes of rotation of the loudspeaker unit 12.

According to various embodiments, the primary mounting bracket 30 may be constructed from a flexible yet semi-rigid material such as sheet metal or polymer. Such a sheet may further be defined by an exterior side 46 and an opposed interior side 48, with the primary mounting bracket 30 likewise being referenced for the sake of consistency. Any suitable grade of sheet metal may be utilized for the construction of the primary mounting bracket 30. It is contemplated that the various parts of the primary mounting bracket 30 described herein are structurally contiguous and integrally formed of a single sheet of material, though alternative embodiments may involve multiple discrete components that are attached to each other with a variety of fastening modalities. The different holes, bends, and extrusions may be formed according to sheet metal working techniques well known in the art.

As best shown in FIGS. 1A and 1B, the primary mounting bracket 30 and more particularly, the arms 34, are rotatably engaged to the enclosure 14 of the loudspeaker unit 12. A left arm 34*a* extends from the left end 38*a* of the arcuate center section 32, while a right arm 34*b* extends from the right end 38*b* of the arcuate center section 32. Because the left arm 34*a* and the right arm 34*b* are identical except for their mirrored positioning/orientation, details pertaining to both will be discussed at once, rather than each individually.

Figure 3B:
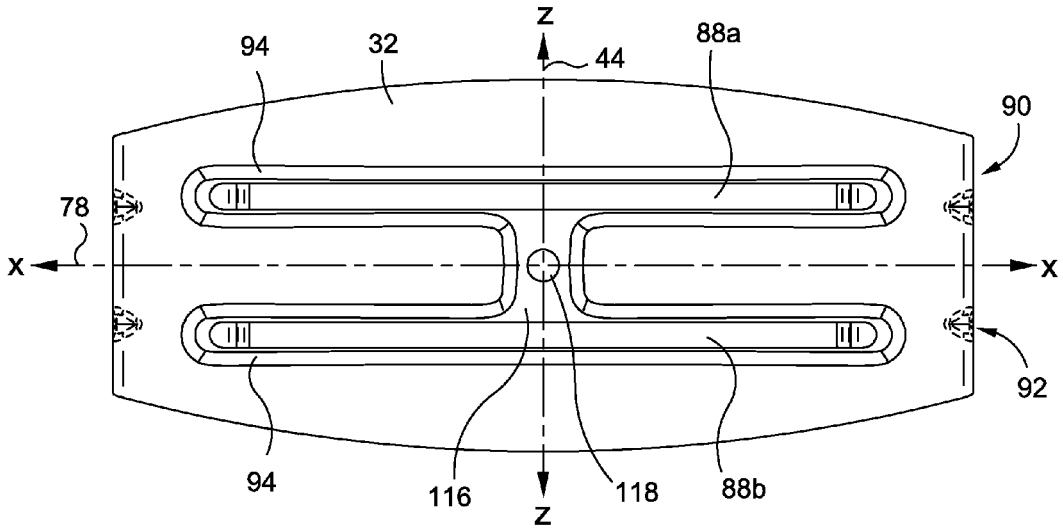
FIG. 3B is a detailed top plan view of the primary mounting bracket.
Figure 3A:
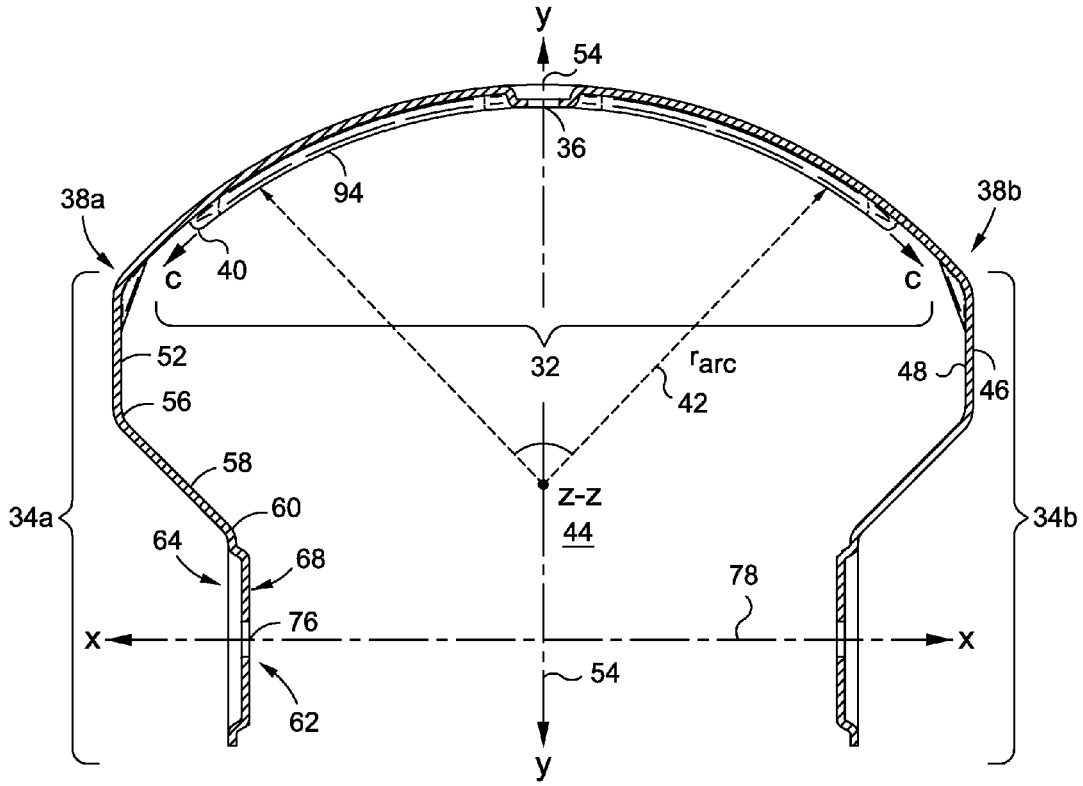
FIG. 3A a detailed cross sectional view of a primary mounting bracket of the apparatus for mounting the loudspeaker to a structure.

In the particular embodiment shown in FIG. 3A, the arm 34 is defined by a base segment 52 that extends in a substantially parallel relationship to a center axis Y-Y 54. There is a slight bend at an elbow 56 to an angled segment 58, and another elbow 60 that bends to a circular planar bearing structure 62 that is in a substantially parallel relationship to the base segment 52, and by definition, the center axis Y-Y 54. The exterior side 46 of the circular planar bearing structure 62 defines a circular inset 64, while the interior side 48 correspondingly defines a circular projection 66. The flat surface of the circular projection 66 is understood to be frictionally engageable to a bracket coupling platform 50, which have a planar surface that is substantially parallel to the direction of radiation 18 of the loudspeaker unit 12. In order to enhance the frictional engagement, the bracket coupling platform 50 may include serrations 68. Along these lines, the curvature associated with the arcuate center section 32, together with the various bends at the elbows 56, 60 exerts an inwardly directed force upon the arms 34, and hence the circular planar bearing structure 62. Although it is contemplated that the circular planar bearing structure 62 is positionable at an arbitrary angle, the serrations 68 may be configured such that there is a step-wise rotational engagement with the bracket coupling platform 50.

The primary mounting bracket 30 is secured to the enclosure 14 via bracket engagement knobs 70 for each of the circular planar bearing structures 62 of the respective arms 34*a*, 34*b*. More particularly, bracket coupling platform 50 further defines a tapped opening 72 that accepts a threaded post 74 on the bracket engagement knob 70. By tightening the bracket engagement knob 70 into the tapped opening 72, the frictional engagement of the primary mounting bracket 30 to the enclosure 14 is increased. The circular planar bearing structure 62 is understood to have an annular configuration with a central hole 76 defined thereby. The threaded post 74 of the bracket engagement knob 70 extends through this central hole 76. An axis X-X 78 is defined between the center of the circular planar bearing structures 62, and the respective central holes 76 thereof. Thus, the central holes 76 are understood to be coaxial with respect to the axis X-X 78. With the enclosure 14 being engaged to the primary mounting bracket 30, the axis X-X 78 also extends through the center of the bracket coupling platform 50 and particularly the tapped opening 72 thereof.

As further shown in FIGS. 1A and 1B, the primary mounting bracket 30 can be rotated about the axis X-X 78 and fixed to a desirable orientation. Generally, the limit of rotation is an upper corner 80 of the enclosure 14 that engages a front edge 82 of the arm 34, as well as a lower stop 84 that engages a rear edge 86 of the arm 34. The specific position of the upper corner 80 and the lower stop 84 as well as the specific shape and size of the primary mounting bracket 30 as it relates to the front edge 82 and rear edge 86 dimensions, permits a range of rotation that is approximately 180°. It will be appreciated, however that these dimensions may be varied to permit a different range of rotation.

Referring now to FIGS. 3A and 3B, the arcuate center section 32 of the primary mounting bracket 30 defines a first open groove 88*a* and a second open groove 88*b*. The open grooves 88 span a substantial length of the arcuate center section 32, and extend in a parallel relationship to each other. The arcuate center section 32 is further bisected by the axis X-X 78 into a front half 90 and a rear half 92. The illustrated embodiment shows that the length and positioning along the arcuate center section 32 is identical between the first open groove 88*a* and the second open groove 88*b*, except that one is defined on the front half 90 and the other is defined on the rear half 92.

Figure 4:
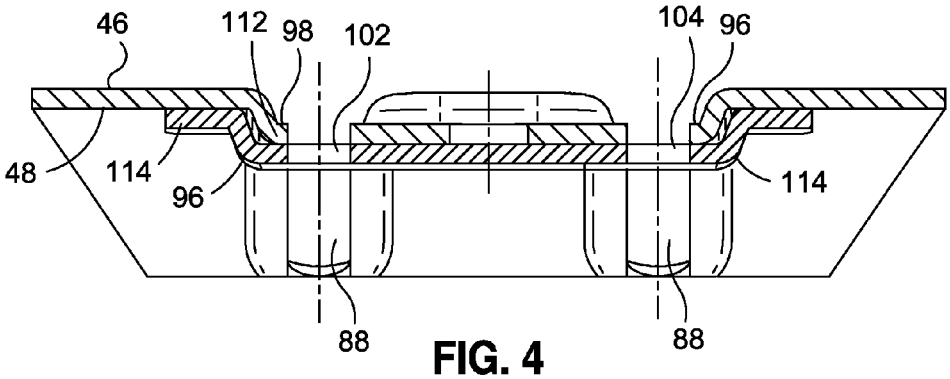
FIG. 4 is a cross-sectional view of the primary mounting bracket with the tab engaged to a pair of tracks defined by the bracket.

With reference to the cross-sectional view of FIG. 4, the interior side 48 of the primary mounting bracket 30 further defines coextensive tracks 94 that are defined by raised edge portions 96 that substantially surround the open grooves 88. One of the contemplated embodiments utilizes stamped sheet metal as the base for the primary mounting bracket 30. In such case, the raised edge portions 96 correspond to recessed edge portions 98 on the exterior side 46 as a result of the stamping process. It will be recognized by those having ordinary skill in the art that other methods for forming the tracks 94 may also be utilized without departing from the scope of the present disclosure.

Figure 5A:
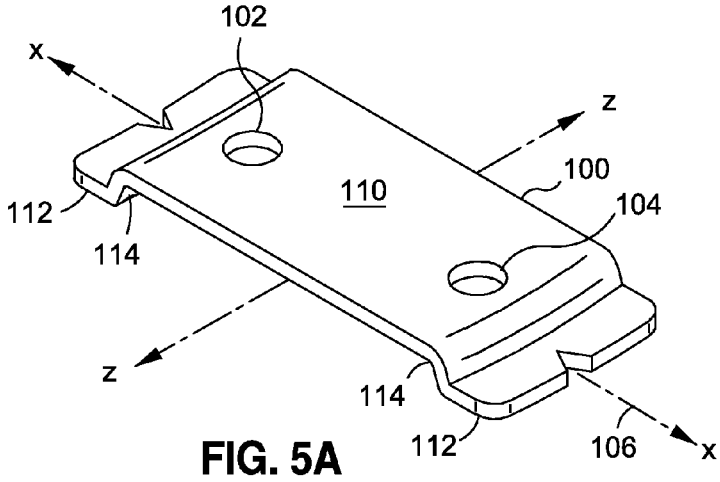
FIG. 5A is a perspective view of the tab.
Figure 5B:
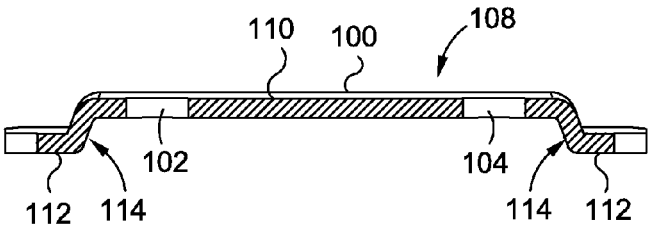
FIG. 5B is a cross-sectional view of the tab along axis x-x shown in FIG. 5A.
Figure 5C:
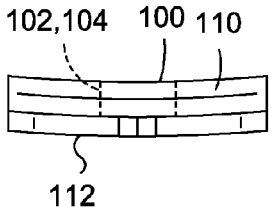
FIG. 5C is a side view of the tab along axis z-z shown in FIG. 5A.

As best shown in FIG. 1B and FIG. 4, in a guided, sliding engagement with the tracks 94 is a tab 100. Generally, the tab 100 is configured to slide along the tracks 94, and the relative position along the arc C-C 40 sets the angle of rotation of the primary mounting bracket 30 about the axis Z-Z 44 per the discussion above. In further details shown in FIGS. 5A, 5B, and 5C, the tab 100 defines a first mounting hardware hole 102 and a second mounting hardware hole 104 that has a center in alignment with a central lateral axis X-X 106. The first mounting hardware hole 102 is positioned along the central lateral axis X-X 106 such that when the tab 100 is engaged to the tracks 94, the first mounting hardware hole 102 is aligned with the first open groove 88*a* on the primary mounting bracket 30. Similarly, the second mounting hardware hole 104 is positioned along the central lateral axis X-X 106 such that when the tab 100 is engaged to the tracks 94, the second mounting hardware hole 104 is aligned with the second open groove 88*b* on the primary mounting bracket 30.

Fasteners 107 may be inserted from an interior side 108, which coincides with the interior side 48 of the primary mounting bracket 30 when engaged thereto, through the mounting hardware holes 102, 104 as well as the open groove 88, and secure the exterior side 46 of the primary mounting bracket 30 against the structure. Thus, the relative position of the tab 100 along the arc C-C 40 defines the angle at which the primary mounting bracket 30 is attached with a center about the axis Z-Z 44. As utilized herein, the fasteners 107 are understood to be any appropriate coupling device such as screws, bolts, and the like that can be attached to the structure.

As mentioned above, the tab 100 is in a sliding engagement with the tracks 94. More particularly, the tab 100 has a raised flat central portion 110 intermediate a pair of lowered foot portions 112. The bottom surface of the lowered foot portions 112 are understood to contact the interior side 48 of the arcuate center section 32. Shoulder portions 114 defined by the junction between the raised flat central portion 110 and the respective lowered foot portions 112 contact the raised edge portions 96 corresponding to the tracks 94, and contributes to centering the tab 100 on the tracks 94. Because the tab 100 slides along the arcuate center section 36, as best shown in the cross-sectional view of FIG. 5C, the tab 100 has a curved or arched profile that substantially matches the profile of the arcuate center section 32.

The movement of the tab 100 along the tracks 94 may be restricted by the fastener 107 inserted through the mounting hardware holes 102, 104, and the limits of the open groove 88. Since the mounting hardware holes 102, 104 are offset from the edges of the tab 100, the tab 100 may extend slightly beyond the tracks 94 when in a fully extended position. End to end, the angle of possible rotation about the axis Z-Z 44 is contemplated to be around 80°, or 40° in each direction relative to the center 36.

Notwithstanding the disclosed use of two fasteners 107, along with the two open grooves 88 on the primary mounting bracket 30 and the corresponding two mounting hardware holes 102 of the tab 100, it is expressly contemplated that fewer (i.e., one) or additional fastener configurations are possible. The need for additional fasteners 107 and the concomitant changes to the configuration of the tab 100 and the primary mounting bracket 30 may depend on the weight and size of the loudspeaker unit 12, or the anticipated installation location and orientation.

In view of the foregoing, a typical installation procedure may first involve securing the fasteners 107 through the tab 100 and the primary mounting bracket 30. Thereafter, the fasteners 107 may be tightened to support the weight of the primary mounting bracket 30 and the loudspeaker unit 12, yet keeping the tab 100 unlocked for further possible rotational adjustment about the axis Z-Z 44. Then, the loudspeaker unit 12 may be attached to the primary mounting bracket 30 with the direction of radiation d 18 being first adjusted about the axis X-X 78 (pitch). When a desired orientation is set, it may be locked by tightening the bracket engagement knob 70. Thereafter, further adjustment about the axis Z-Z 44 (roll) may be made, and finally secure the tab 100, the primary mounting bracket 30, and hence the loudspeaker unit 12 to the structure by completely tightening the fasteners 107. The appropriate torque levels to be applied may depend on the underlying material of the structure.

Although the terms pitch and roll have been referenced parenthetically above, it is by way of example only and not of limitation. It will be recognized that as the loudspeaker unit 12 is rotated further along either the axis X-X 78 or the axis Z-Z 44, a rotation about the other axis becomes something else relative to the direction of radiation d 18. For example, in the position shown in FIG. 1A, rotating about the axis Z-Z 44 results in a roll, whereas in the position shown in FIG. 1B, the same rotation results in a yaw.

Instead of the final tightening of the fasteners 107 after securing the loudspeaker unit 12 to the primary mounting bracket 30, such step may be completed beforehand. Along these lines, it is expressly contemplated that the fasteners 107 and the bracket engagement knobs 70 may be maintained in a semi-loose state while adjustments about both the axis X-X 78 and the axis Z-Z 44 may be made concurrently.

Figure 6:
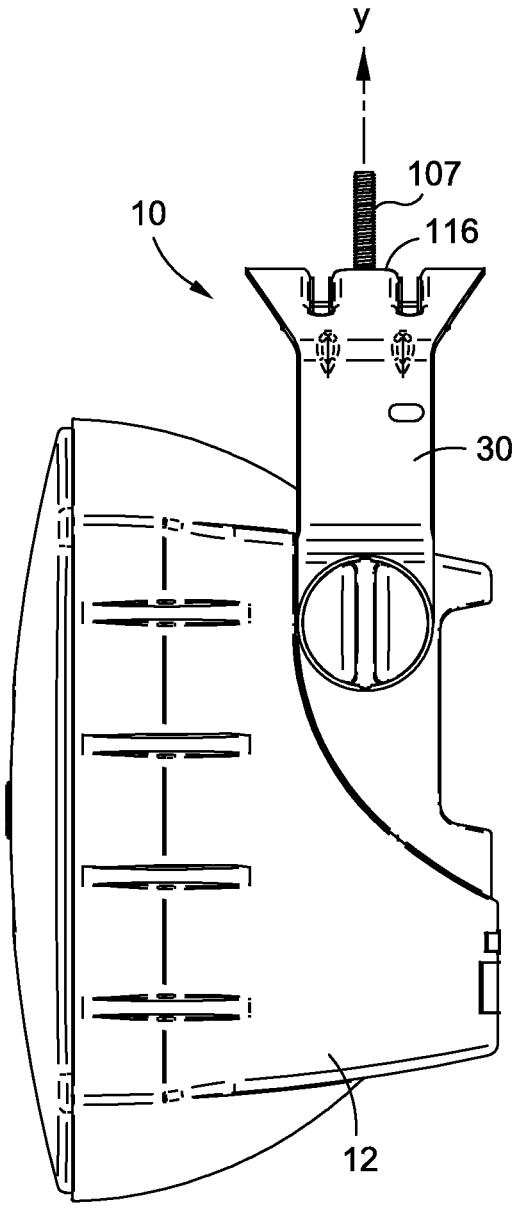
FIG. 6 is a side plan view of the loudspeaker assembly mounted to a fixed mounting point on the primary mounting bracket.

With reference to FIG. 6, as an alternative to utilizing the tab 100 as a securement point to rotatably mount the primary mounting bracket 30 to the structure, a fixed mounting point thereon may be utilized. FIG. 3B further depicts a central recessed bridge 116 that defines a static mounting hole 118 that is tapped to accept the threaded fastener 107. It is envisioned that the loudspeaker unit 12 is then capable of being rotated about the center axis Y-Y 54. Additional means such as locknuts may be used to secure the rotational position of the primary mounting bracket 30.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. An apparatus for mounting a loudspeaker unit to a structure, the apparatus comprising:

a primary mounting bracket defined by an arcuate center section and a pair of opposed arms extending therefrom, the arcuate center section defining at least one open groove and at least one substantially coextensive track spanning a part of the arcuate center section, and each of the arms defining a base segment, an inwardly angled segment, and a circular planar bearing structure rotatably engagable to a corresponding one of bracket coupling platforms on an enclosure of the loudspeaker unit, the circular planar bearing structures of each of the arms being aligned with respective opposed ends of the at least one open groove; and a tab in a guided sliding engagement with the track defined on the arcuate center section of the primary mounting bracket, the tab defining at least one mounting hardware hole in axial alignment with the at least one open groove substantially throughout its length;

wherein the enclosure of the loudspeaker unit is rotatable about a first axis extending between the arms of the primary mounting bracket and about a second axis defined by a radial center of an arc corresponding to a travel path of the tab along the track, the radial center of the arc being offset from the first axis.

2. The apparatus of claim 1, wherein the circular planar bearing structures each has an annular configuration and defines a central coaxial opening.

3. The apparatus of claim 2, further comprising:

a bracket engagement knob frictionally coupling a one of the circular planar bearing structures to the respective one of the bracket coupling platforms, the bracket engagement knob including a threaded post extending through the central opening of the circular planar bearing structure and threadably engaged to a correspondingly tapped hole defined by the bracket coupling platform.

4. The apparatus of claim 3, wherein the bracket coupling platforms are serrated for stepwise rotational engagement to the circular planar bearing structures.

5. The apparatus of claim 1, wherein the tab has an arcuate surface substantially corresponding to the arcuate center section of the primary mounting bracket.

6. The apparatus of claim 1, wherein the primary mounting bracket is defined by an interior surface and an exterior surface, the track being raised on the interior surface with the tab being slidably engageable thereon.

7. The apparatus of claim 1, further comprising:

a first coupling member attachable to the structure and the primary mounting bracket, the first coupling member further being securable to the tab through the open groove.

8. The apparatus of claim 7, wherein the first coupling member is threadably engaged to a first one of the mounting hardware hole defined by the tab.

9. The apparatus of claim 8, further comprising a second coupling member attachable to the structure and the primary mounting bracket, the second coupling member further being securable to the tab through the open groove and threadably engaged to a second one of the mounting hardware hole defined by the tab.

10. The apparatus of claim 1, wherein the arcuate center section includes a fixed mounting point, the enclosure of the loudspeaker unit being rotatable about a third axis extending normal to the fixed mounting point.

11. The apparatus of claim 1, wherein the enclosure of the loudspeaker unit is rotatable approximately 180 degrees about the first axis.

12. The apparatus of claim 1, wherein the enclosure of the loudspeaker unit is rotatable approximately 80 degrees about the second axis.

13. A loudspeaker assembly mountable to a structure, comprising:

a loudspeaker enclosure including a pair of opposite bracket coupling platforms;

a primary mounting bracket defined by an arcuate center section and a pair of opposed arms extending therefrom, the arcuate center section defining at least one open groove and at least one substantially coextensive track spanning a part of the arcuate center section, and each of the arms defining a base segment, an inwardly angled segment, and a circular planar bearing structure rotatably engagable to a corresponding one of bracket coupling platforms on an enclosure of the loudspeaker unit, the circular planar bearing structures of each of the arms being aligned with respective opposed ends of the at least one open groove; and a tab in a guided sliding engagement with the track defined on the arcuate center section of the primary mounting bracket, the tab defining at least one mounting hardware hole in axial alignment with the at least one open groove substantially throughout its length;

wherein the enclosure is rotatable about a first axis extending between the arms of the primary mounting bracket and about a second axis defined by a radial center of an arc corresponding to a travel path of the tab along the track, the radial center of the arc being offset from the first axis.

14. The loudspeaker assembly of claim 13, wherein the circular planar bearing structures each has an annular configuration and defines a central coaxial opening.

15. The loudspeaker assembly of claim 14, further comprising:

a bracket engagement knob frictionally coupling a one of the circular planar bearing structures to the respective one of the bracket coupling platforms, the bracket engagement knob including a threaded post extending through the central opening of the circular planar bearing structure and threadably engaged to a correspondingly tapped hole defined by the bracket coupling platform.

16. The loudspeaker assembly of claim 15, wherein the bracket coupling platforms are serrated for stepwise rotational engagement to the circular planar bearing structures.

17. The loudspeaker assembly of claim 13, wherein the tab has an arcuate surface substantially corresponding to the arcuate center section of the primary mounting bracket.

18. The loudspeaker assembly of claim 13, wherein the primary mounting bracket is defined by an interior surface and an exterior surface, the track being raised on the interior surface with the tab being slidably engageable thereon.

19. The loudspeaker assembly of claim 13, further comprising:

a first coupling member attachable to the structure and the primary mounting bracket, the first coupling member further being securable to the tab through the open groove.

20. The loudspeaker assembly of claim 19, wherein the first coupling member is threadably engaged to a first one of the mounting hardware hole defined by the tab.

21. The loudspeaker assembly of claim 20, further comprising a second coupling member attachable to the structure and the primary mounting bracket, the second coupling member further being securable to the tab through the open groove and threadably engaged to a second one of the mounting hardware hole defined by the tab.

22. The loudspeaker assembly of claim 13, wherein the enclosure is rotatable approximately 180 degrees about the first axis.

23. The loudspeaker assembly of claim 13, wherein the enclosure is rotatable approximately 80 degrees about the second axis.

* * * * *